US008287154B2

(12) United States Patent
Park

(10) Patent No.: US 8,287,154 B2
(45) Date of Patent: Oct. 16, 2012

(54) LED LIGHTING APPARATUS

(76) Inventor: Ho Byung Park, Icheon-si (KR)

( * ) Notice: Subject to any disclaimer, the term of this patent is extended or adjusted under 35 U.S.C. 154(b) by 148 days.

(21) Appl. No.: 12/994,144

(22) PCT Filed: May 22, 2009

(86) PCT No.: PCT/KR2009/002702
§ 371 (c)(1),
(2), (4) Date: Nov. 22, 2010

(87) PCT Pub. No.: WO2009/142449
PCT Pub. Date: Nov. 26, 2009

(65) Prior Publication Data

US 2011/0075419 A1 Mar. 31, 2011

(30) Foreign Application Priority Data

May 22, 2008 (KR) ..... 10-2008-0047658
Aug. 5, 2008 (KR) ..... 10-2008-0076321

(51) Int. Cl.
*F21S 4/00* (2006.01)
*F21V 21/00* (2006.01)

(52) U.S. Cl. ..... 362/249.02; 362/800

(58) Field of Classification Search ..... 362/249.02–249.06, 800
See application file for complete search history.

(56) References Cited

FOREIGN PATENT DOCUMENTS

| | | |
|---|---|---|
| JP | 2003-229014 | 8/2003 |
| JP | 2005-321281 | 11/2005 |
| JP | 2005-340184 | 12/2005 |

OTHER PUBLICATIONS

International Search Report for PCT/KR2009/002702, Dec. 30, 2009.

*Primary Examiner* — Jason Moon Han
(74) *Attorney, Agent, or Firm* — Lowe Hauptman Ham & Berner, LLP

(57) ABSTRACT

The lighting device is provided with lamp housing, LED module, terminal cover, and light penetrating hood. Lamp housing comprises base, heat sink on the base, thermal dissipation channel between neighboring two heat sinks, and the base inner container. LED module comprises base for fixing, lamp cover attached to the side of the base, multiple LED lamp being inside the lamp cover, and connecting part connected to the corresponding container on the base. Each terminal cover seals the forward and reward part of the lamp housing, and the light penetrating hood is connected below the lamp housing, and the container for LED module is surrounded with the lamp housing, the terminal cover, and the light penetrating hood. This utility model can simplify the manufacturing process and cut down the cost and time to research and develop.

13 Claims, 10 Drawing Sheets

【FIG.1】
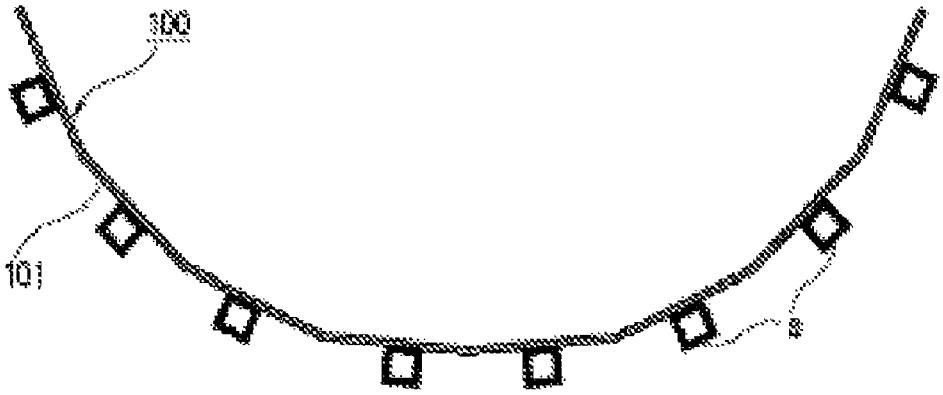
【FIG.2】
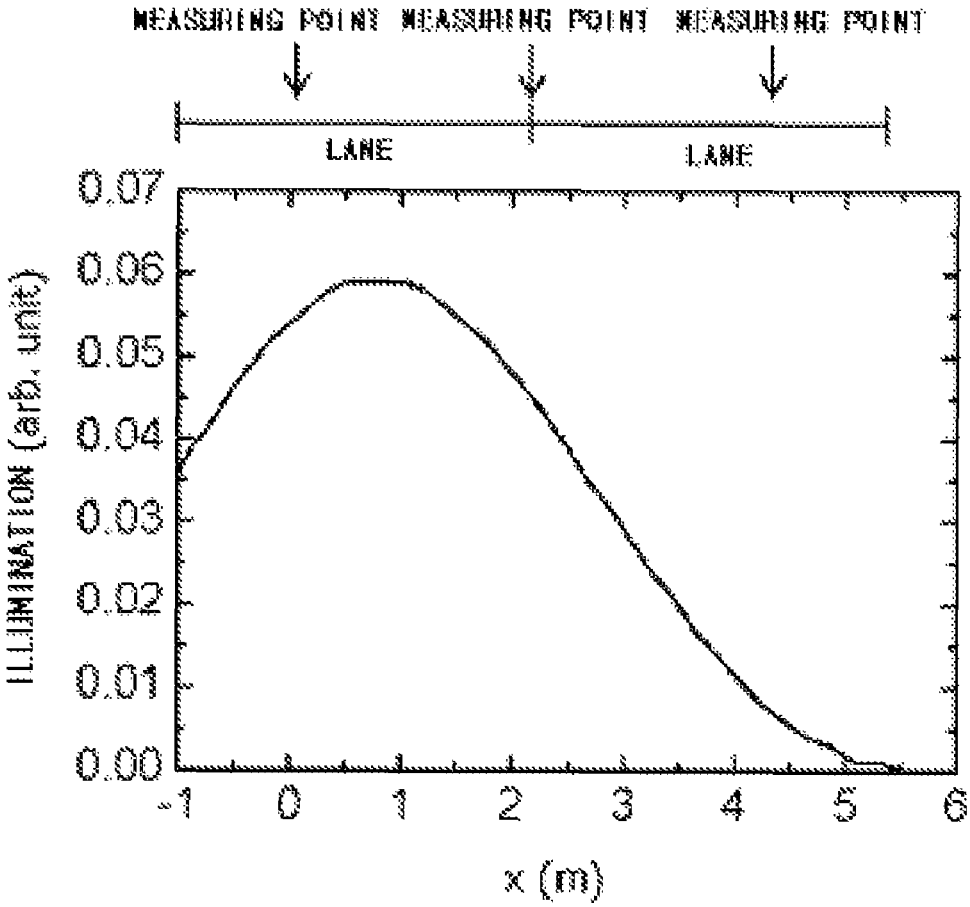

【FIG.3】
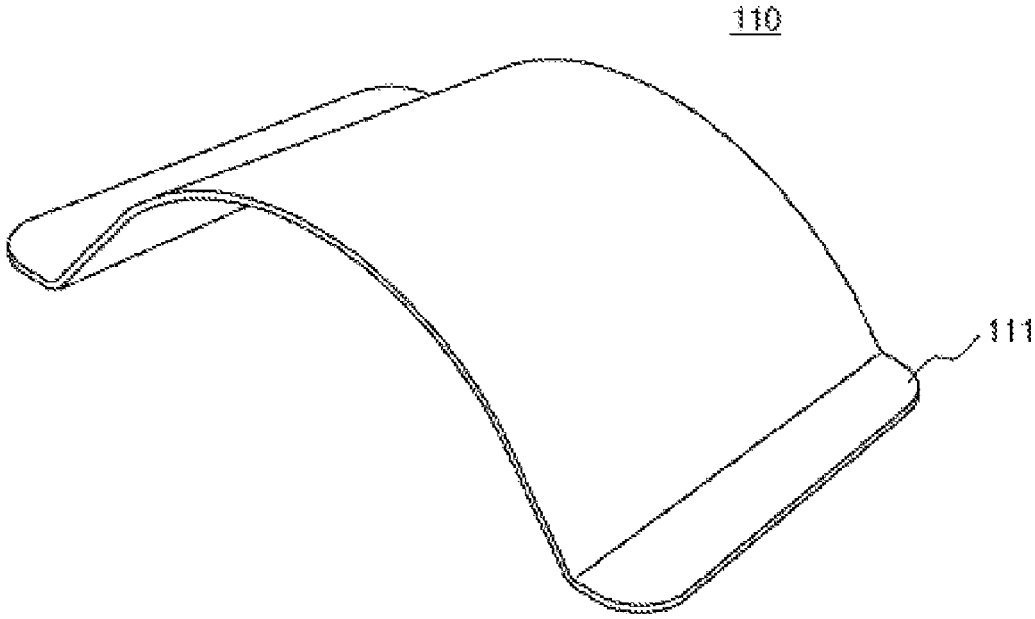
【FIG.4】
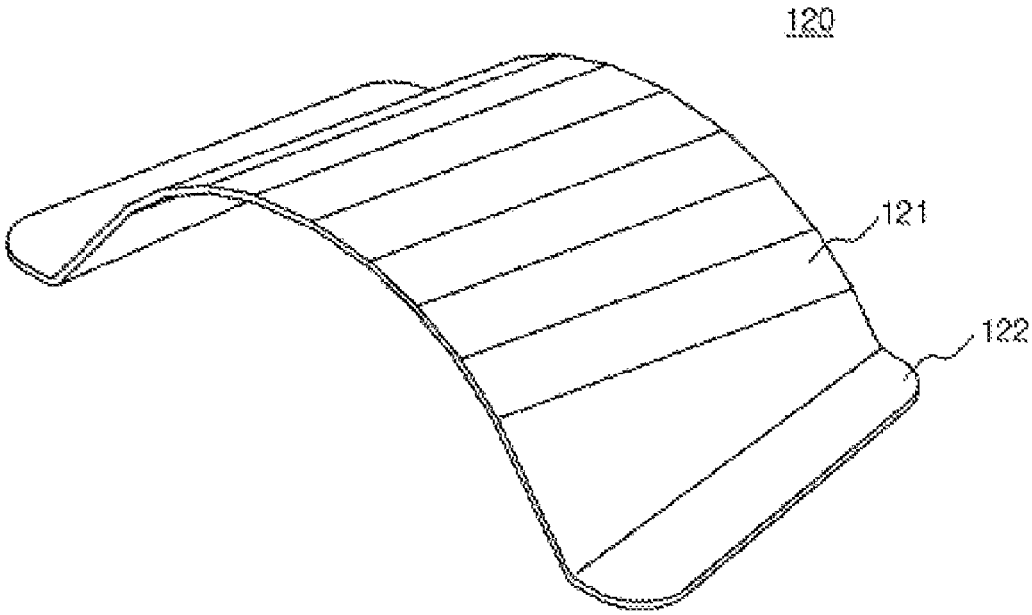

【FIG.5】
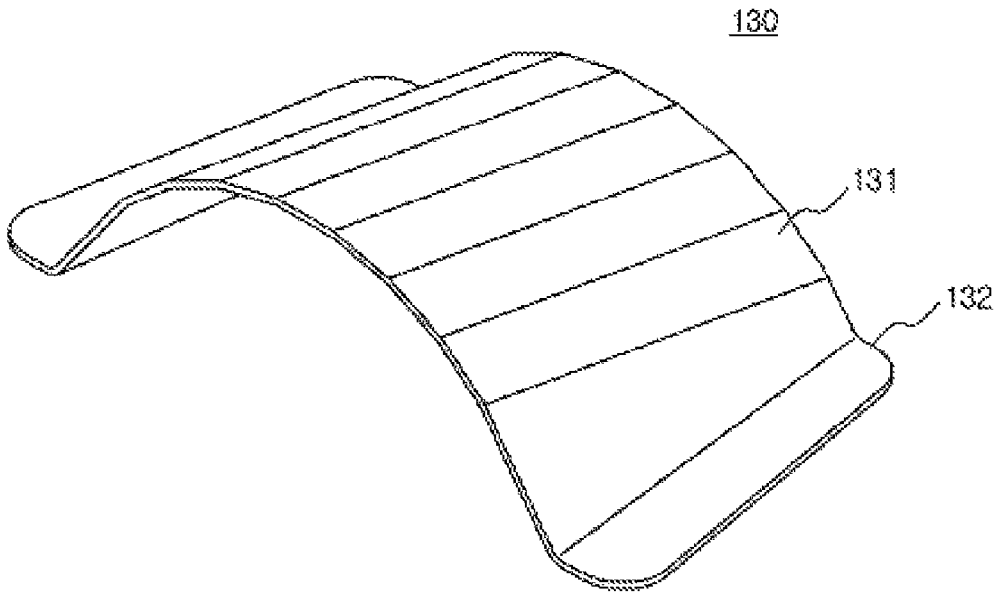
【FIG.6】
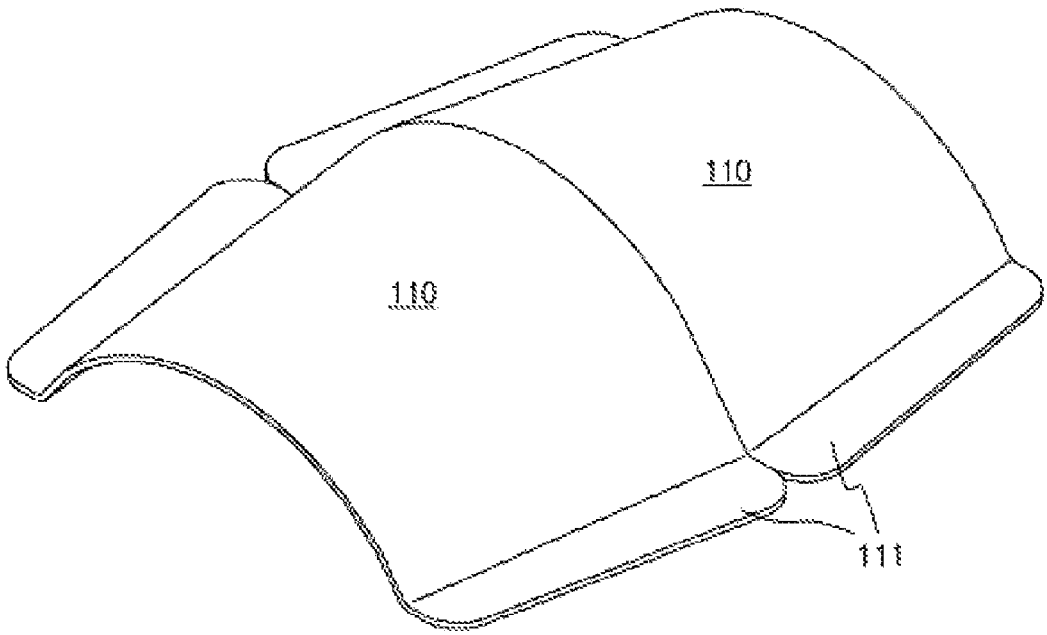

【FIG.7】
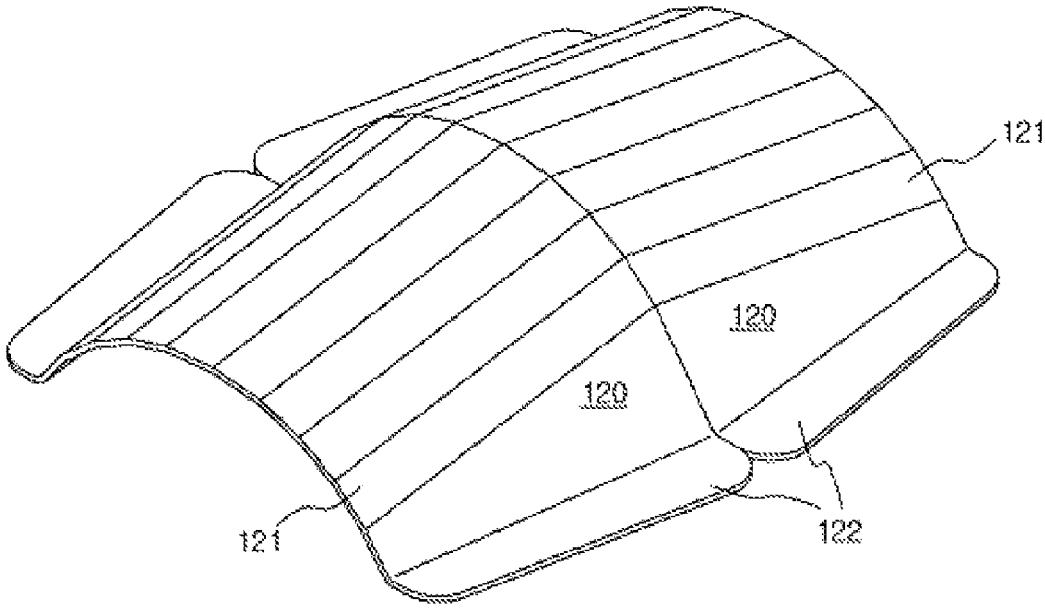
【FIG.8】
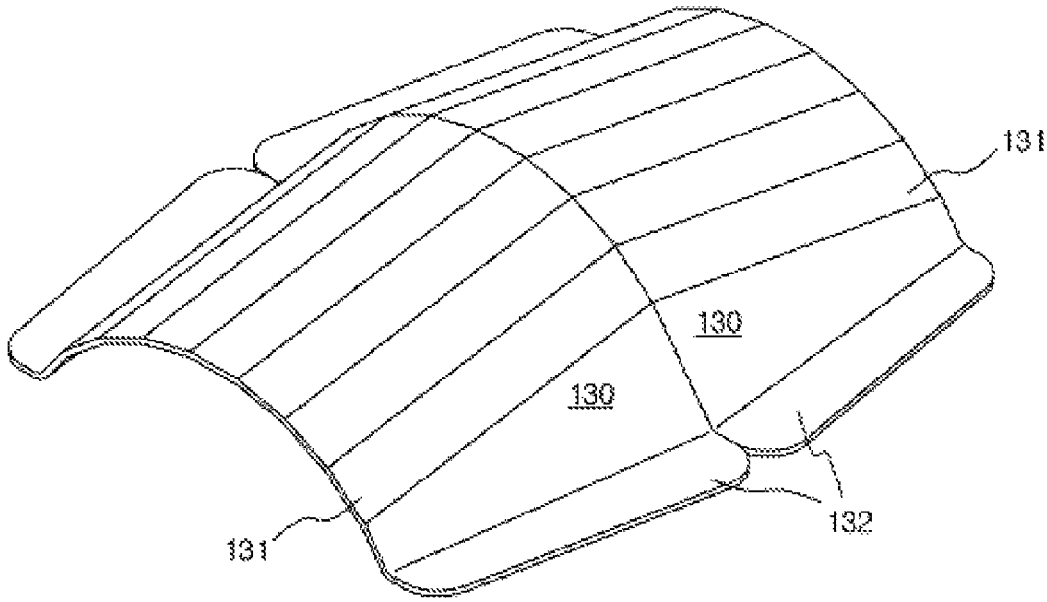

【FIG.9】
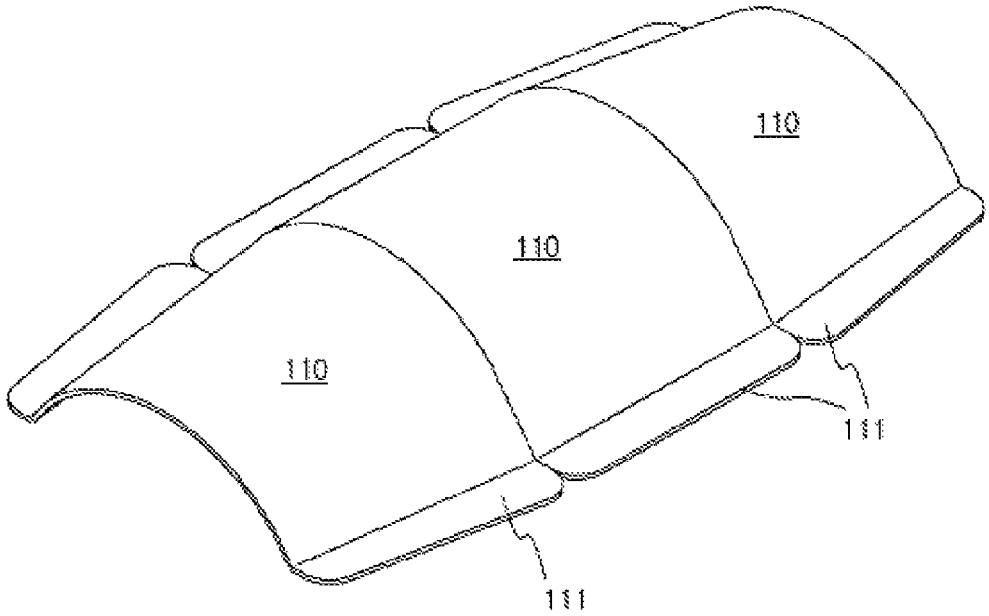
【FIG.10】
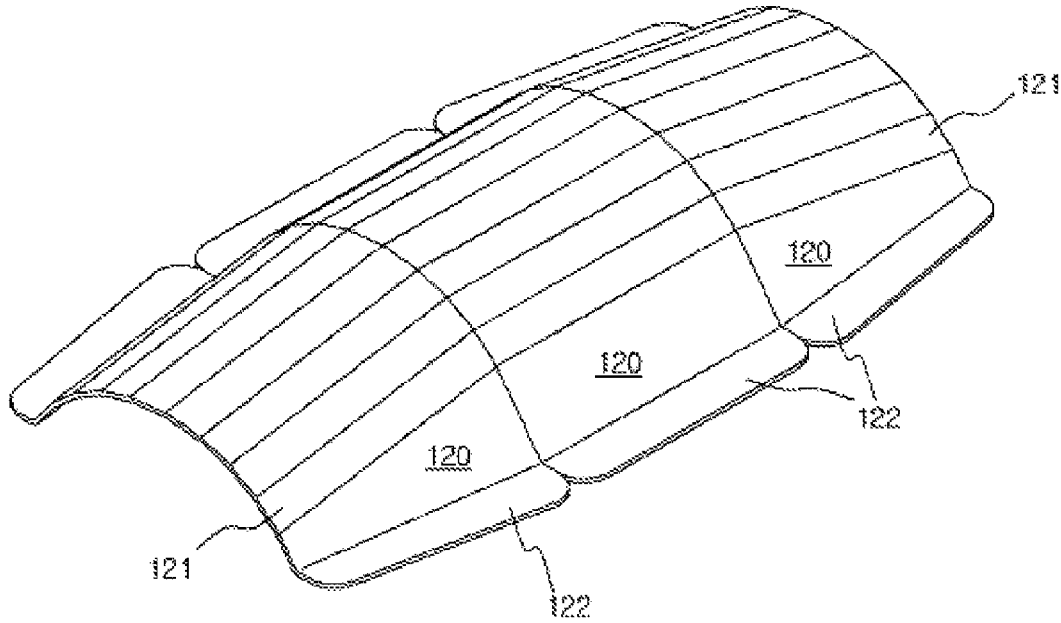

【FIG.11】
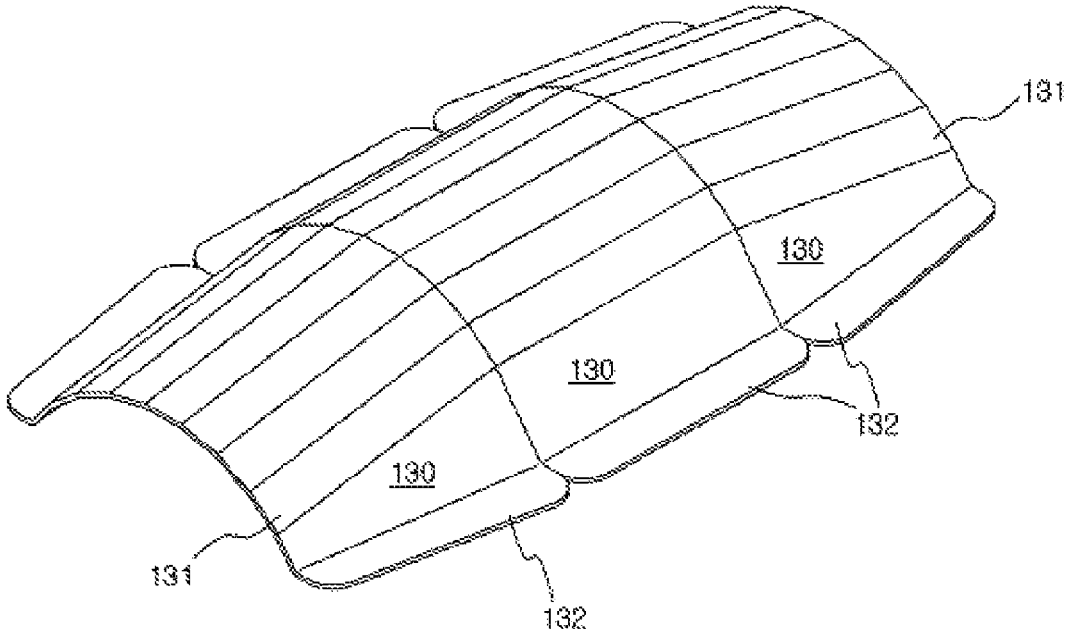
【FIG.12】
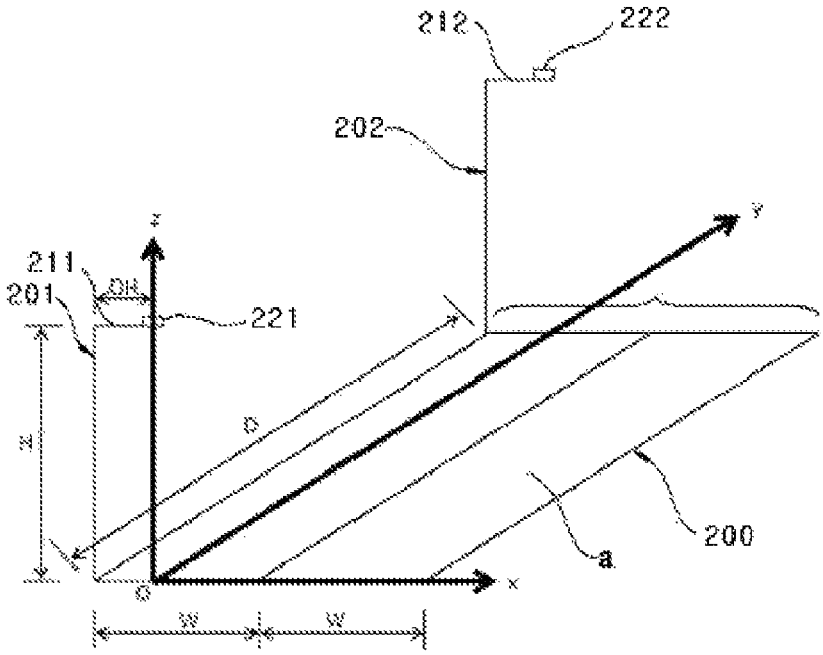

【FIG.13】
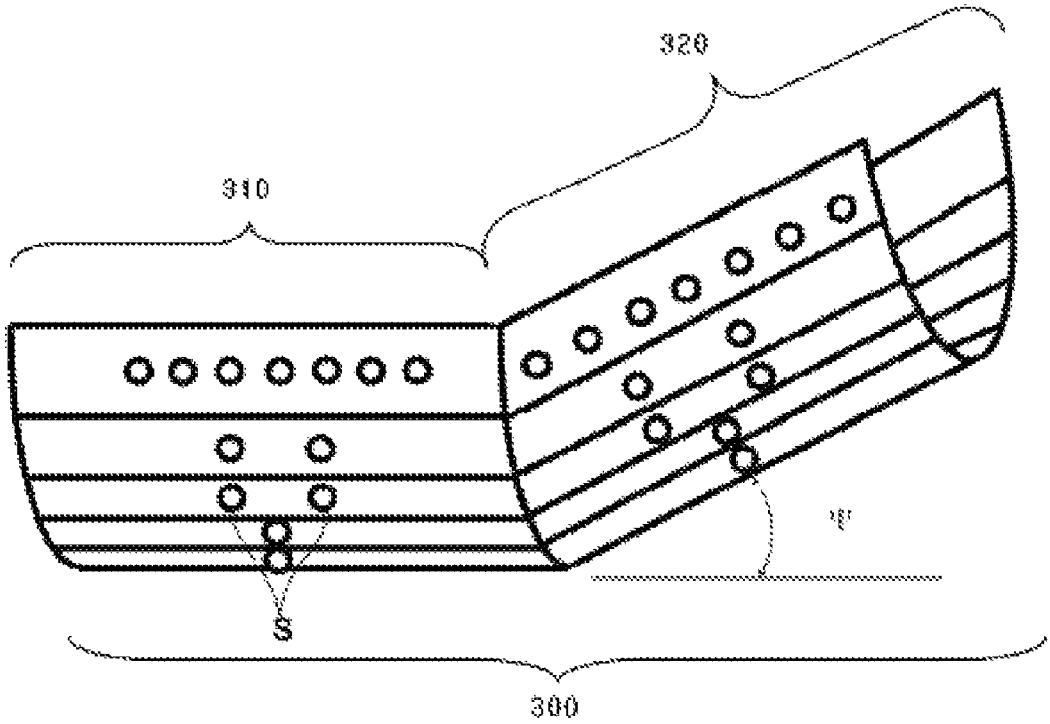
【FIG.14】
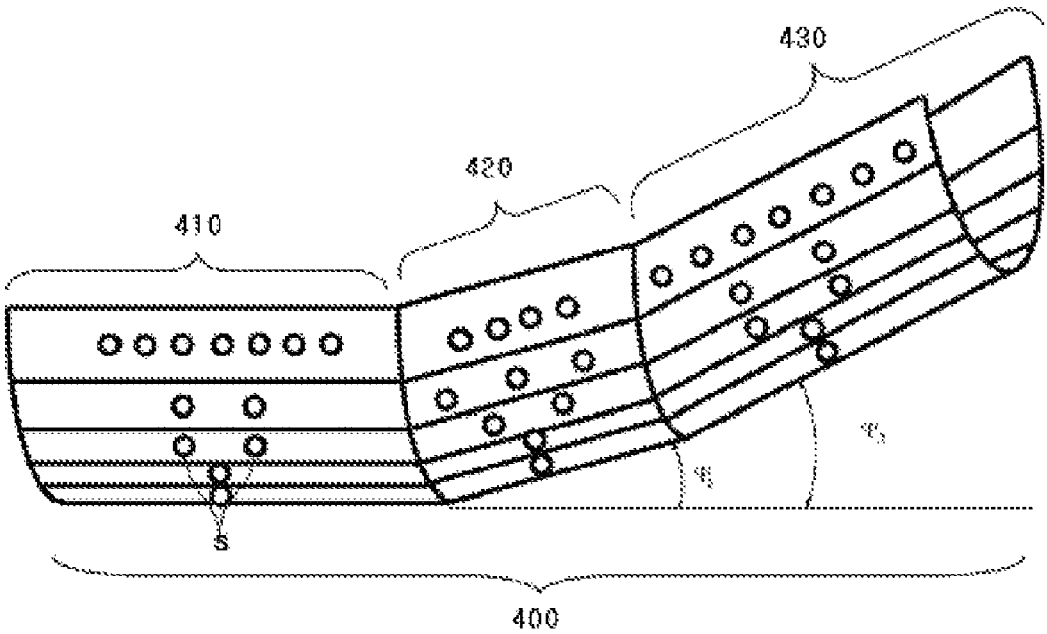

【FIG.15】
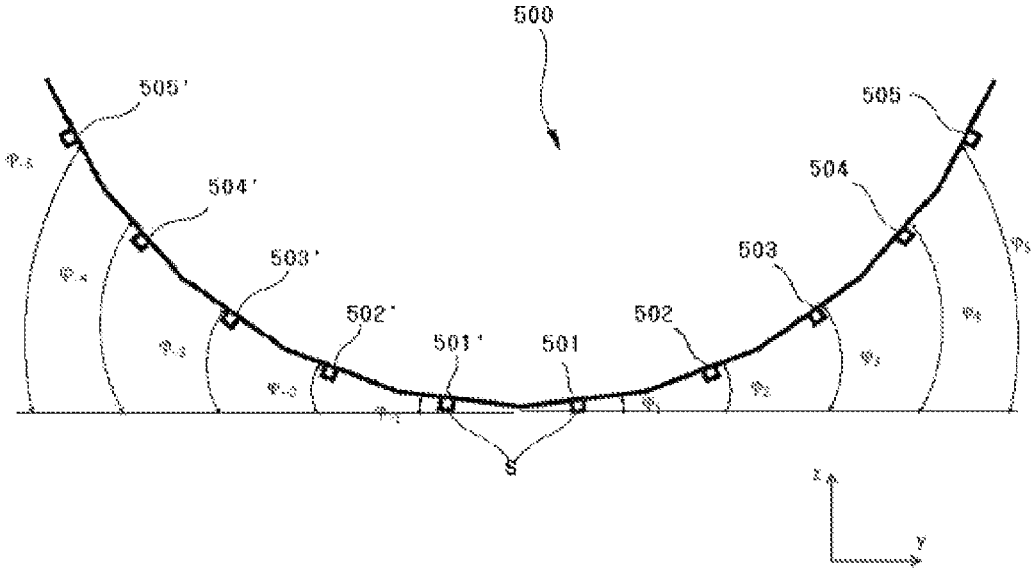
【FIG.16】
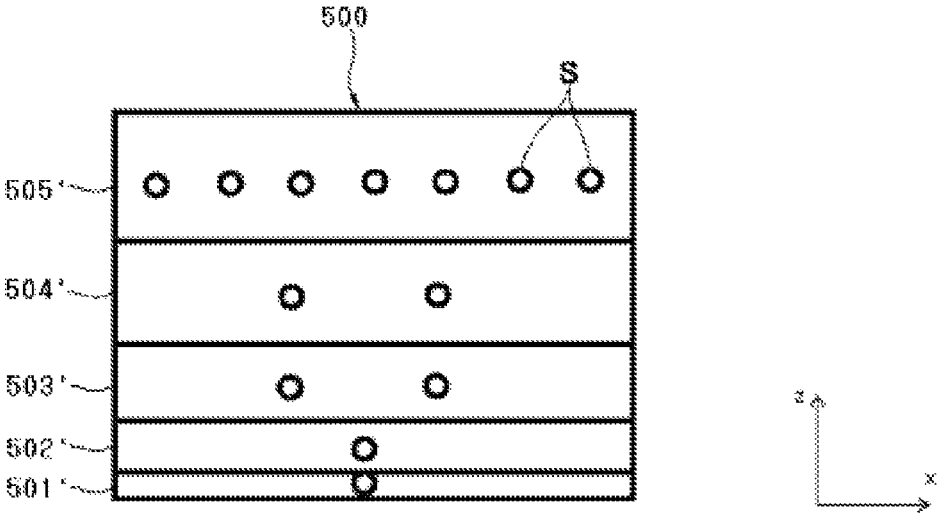

【FIG.17】
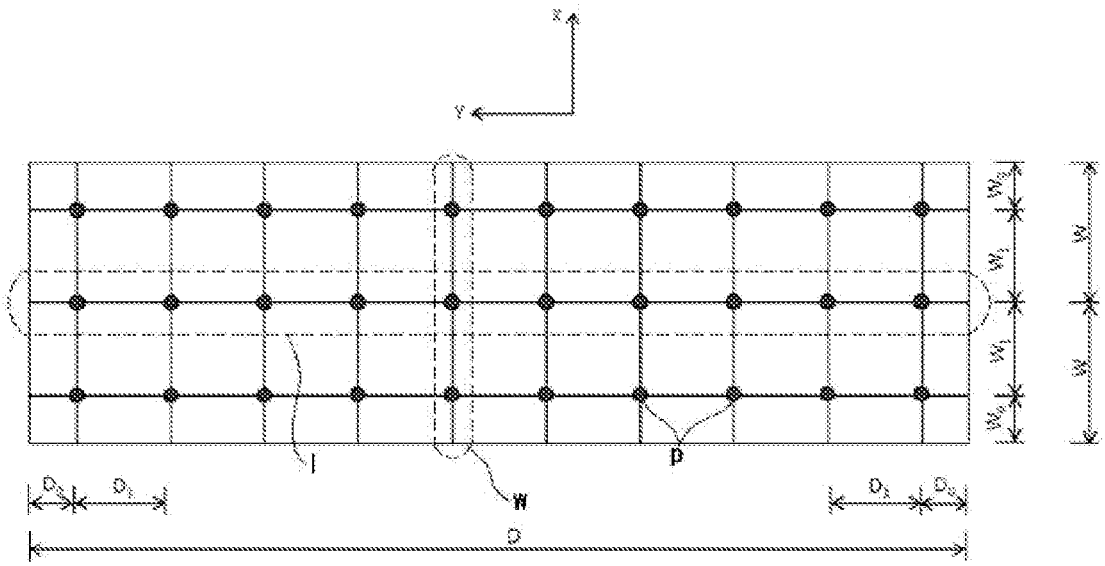
【FIG.18】
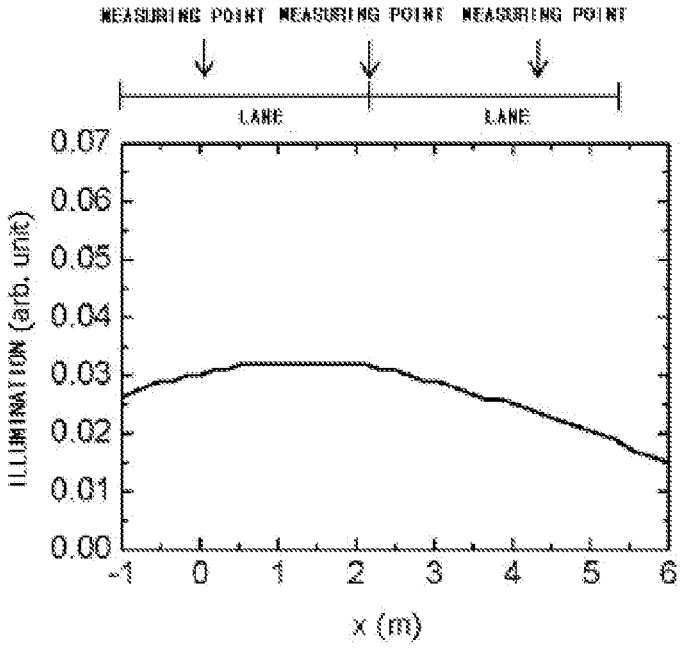

【FIG.19】
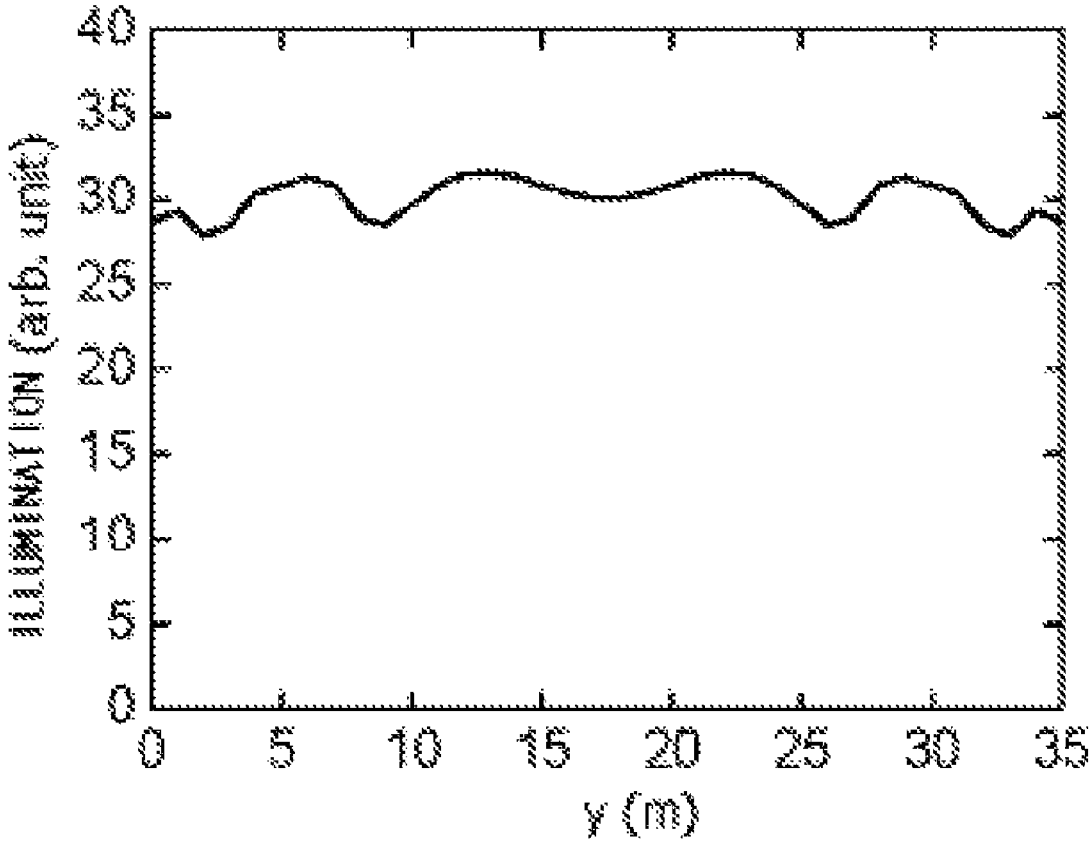

LED LIGHTING APPARATUS

CROSS REFERENCE TO RELATED APPLICATION

This application claims the priority of Korean Patent Application No. 10-2008-0047658, filed on May 22, 2008 and Korean Patent Application No. 10-2008-0076321, filed on Aug. 5, 2008 in the KIPO (Korean Intellectual Property Office), the disclosure of which is incorporated herein in their entirety by reference. Further, this application is the National Phase application of International Application No. PCT/KR2009/002702, filed May 22, 2009, which designates the United States and was published in English. Each of these applications is hereby incorporated by reference in their entirety into the present application.

TECHNICAL FIELD

The present invention relates to a Light Emitting Diode (LED) lighting apparatus, and more particularly, to an LED lighting apparatus capable of focusing the maximum quantity of light within a desired illuminating region.

BACKGROUND ART

In general, a street light is a lighting apparatus which is provided to illuminate a roadway to enhance traffic safety, and is usually supported on a lamp post. Conventional street lights adopt, e.g., a mercury lamp or a sodium lamp as a light source.

These conventional street lights using the aforementioned light source have disadvantages, such as high power consumption and short lifespan, and therefore, a novel street light using a Light Emitting Diode (LED), which exhibits remarkably low power consumption and has a nearly indefinite lifespan, has been actively studied and developed.

In current LED street lights, plural LEDs are arranged in a planar structure. However, LED street lights configured in this manner suffer from a spotlight phenomenon wherein the region immediately below the LED street light is considerably brighter than peripheral regions.

Recently, as illustrated in FIG. 1, a street light 100, in which LEDs are arranged on a curved structure 101, has been proposed. Arranging the LEDs on the curved structure 101 may somewhat increase illuminance uniformity on the surface below the street light. (in a direction to parallel to a roadway)

However, the above described LED street light has difficulty uniformly illuminating all of a plurality of lanes of a roadway because LEDs have a narrow view angle, or suffers from deterioration in lighting performance. For example, if it is assumed that the above described LED street light is installed above a two-lane road having a lane width of 3.2 m, light may be unevenly distributed in a direction perpendicular to a lane as illustrated in FIG. 2, causing severe variation in per lane illuminance.

DISCLOSURE

Technical Problem

Therefore, the present invention has been made in view of the above problems, and it is one object of the present invention to provide a Light Emitting Diode (LED) lighting apparatus, which can achieve reduced power consumption and increased energy efficiency while exhibiting effective lighting effects by evenly distributing light in both directions parallel to and perpendicular to a roadway.

It is another object of the present invention to provide an LED lighting apparatus, which can focus the maximum quantity of light within a desired illuminating region while preventing rearward light leakage and minimizing the exposure of pedestrians and vehicles to glare, resulting in highly effective roadway lighting.

Technical Solution

In accordance with one aspect of the present invention, the above and other objects can be accomplished by the provision of (1) a Light Emitting Diode (LED) lighting apparatus installed at a location where a bottom surface requires uniform illuminance or luminance distribution, the LED lighting apparatus comprising LED lighting unit modules having a plurality of LED light sources arranged on an inner or outer curved surface of a substantially half cylinder member, wherein two or more LED lighting unit modules are arranged in a longitudinal direction of the LED lighting apparatus.

(2) According to the invention (1), the half cylinder member may have a width directional cross section in which curvilinear or segmented straight lines are consecutively connected to each other.

(3) According to the invention (1), the LED lighting unit module may include a plurality of LED flat plate modules on which the LED light sources are arranged, and the neighboring LED flat plate modules may be arranged to form an angle of 150° or more and 175° or less therebetween in a width direction thereof.

(4) According to the invention (1), the neighboring LED lighting unit modules may be arranged to have a coupling angle of 40° or less therebetween in a longitudinal direction thereof.

(5) In accordance with another aspect of the present invention, there is provided a Light Emitting Diode (LED) lighting apparatus installed at a location where a bottom surface requires uniform illuminance or luminance distribution, the LED lighting apparatus including LED lighting unit modules composed of a plurality of LED flat plate modules on which LED light sources are arranged, wherein an angle between 2n or 2n+1 LED flat plate modules of the LED lighting unit module (here, n is a natural number equal to or greater than 3) and an arrangement direction (y-axis) of the LED lighting apparatus is represented by $\phi_i$ (here, i=−n, −n+1, . . . , −1, +1, . . . , n although 2n+1 LED flat plate modules includes i=0), wherein an angle between the neighboring LED flat plate modules is represented by $180°-(\phi_{\pm i\pm 1}-\phi_{\pm i})$ or $180°-(\phi_{+1}+\phi_{-1})$ (double signs in the same order) (here, i=1, 2, . . . , n−1 although 2n+1 LED flat plate modules includes i=0) and is in a range of 150° or more and 175° or less, and wherein the LED light sources are installed on an inner or outer curved surface of the LED lighting unit module.

(6) According to the invention (5), there is provided a Light Emitting Diode (LED) lighting apparatus installed at a location where a bottom surface requires uniform illuminance or luminance distribution, the LED lighting apparatus including LED lighting unit modules composed of a plurality of LED flat plate modules on which LED light sources are arranged, wherein an angle between 2n or 2n+1 LED flat plate modules of the LED lighting unit module (here, n is a natural number equal to or greater than 3) and an arrangement direction (y-axis) of the LED lighting apparatus is represented by $\phi_i$ (here, i=−n, −n+1, . . . , −1, +1, . . . , n although 2n+1 LED flat plate modules includes i=0), wherein an angle between the neighboring LED flat plate modules is represented by $180°-(\phi_{\pm i\pm 1}-\phi_{\pm i})$ or $180°-(\phi_{+1}+\phi_{-1})$ (double signs in the same order) (here, i=1, 2, . . . , n−1 although 2n+1 LED flat plate modules includes i=0) and is in a range of 150° or more and 175° or less, and wherein the LED light sources are installed on an inner or outer curved surface of the LED lighting unit module, and m LED lighting unit modules are consecutively arranged in a direction x-axis (perpendicular to the y-axis) (here, m is a natural number equal to or greater than 2).

(7) According to the invention (6), a coupling angle between the m LED lighting unit modules may satisfy the relationship $\psi_j \leqq 40°$ (here, j=2, 3, . . . , m).

(8) According to one of the invention (5) to (7), a luminous flux of the $i^{th}$ LED flat plate module of the 2n or 2n+1 LED flat plate modules (here, n is a natural number equal to or greater than 3) may satisfy the relationship $\Phi_{\pm i} \leqq \Phi_{\pm i\pm 1}$ (double signs in the same order) (here, i=1, 2, . . . , n−1 although 2n+1 LED flat plate modules includes i=0), and also, may satisfy the relationship $\Phi_{\pm n}/\Phi_{\pm 1} \geqq 2$ (double signs in the same order) or the relationship $\Phi_{\pm n}/\Phi_0 \geqq 2$.

(9) According to one of the invention (5) to (7), a luminous flux of the $i^{th}$ LED flat plate module of the 2n or 2n+1 LED flat plate modules (here, n is a natural number equal to or greater than 3) may satisfy the relationship $\Phi_{\pm i} \leqq \Phi_{\pm i\pm 1}$ (double signs in the same order) (here, i=1, 2, . . . , n−1 although 2n+1 LED flat plate modules includes i=0), and also, may satisfy the relationship $\Phi_{\pm n}/\Phi_{\pm 1} \geqq 5$ (double signs in the same order) or the relationship $\Phi_{\pm n}/\Phi_0 \geqq 5$.

(10) According to the invention (8), each of the LED light sources may include an LED, or an assembly of an LED and a lens, and has a view angle range ($\Delta\eta$) of ±5° or more and ±20° or less.

(11) According to one of the invention (7) or (10), the two LED lighting unit modules are coupled to each other so as to satisfy the relationship $(\Delta\eta-5°) \leqq \psi \leqq (\Delta\eta+5°)$ between a coupling angle $\psi$ and a view angle range $\Delta\eta$.

(12) According to one of the invention (7) or (10), the three or more LED lighting unit modules are coupled to each other so as to satisfy the relationship) $(\Delta\eta-5°) \leqq (\psi_{j+1}-\psi_j) \leqq (\alpha\eta+5°)$ (here, j=2, 3, . . . , m) between a coupling angle $\psi$ and a view angle range $\Delta\eta$.

(13) According to one of the invention (7) or (10), the three or more LED lighting unit modules are coupled to each other so as to satisfy the relationship) $(\Delta\eta-5°)/(m-1) \leqq (\psi_{j+1}-\psi_j) \leqq (\Delta\eta+5°)/(m-1)$ (here, j=2, 3, . . . , m) between a coupling angle $\psi_1$ and a view angle range $\Delta\eta$.

Advantageous Effects

According to the present invention, a Light Emitting Diode (LED) lighting apparatus using LED light sources can achieve uniform light distribution that is essential trait of a street light.

In addition to the uniform light distribution trait of a street light, the LED lighting apparatus of the present invention can minimize the exposure of a driver to glare by focusing light within a desired illuminating region while minimizing rearward light leakage, resulting in highly effective lighting. Accordingly, the LED lighting apparatus may be applied to a variety of lighting apparatuses including a safety light, a tunnel light, or a courtesy light. Extension of LED lighting to these fields provides considerable advantages both in terms of reduced power consumption and environmental impact, constituting a major advance in the field of LED lighting.

DESCRIPTION OF DRAWINGS

The above and other objects, features and other advantages of the present invention will be more clearly understood from the following detailed description taken in conjunction with the accompanying drawings, in which:

FIG. 1 is a perspective view illustrating a conventional LED lighting apparatus;

FIG. 2 is a graph illustrating luminance distribution of the conventional LED lighting apparatus;

FIGS. 3 to 11 are perspective views illustrating various configurations of an LED lighting unit module constituting an LED lighting apparatus according to the present invention;

FIG. 12 is a view schematically illustrating an installation example of the LED lighting apparatus according to the present invention;

FIG. 13 is a perspective view schematically illustrating one example of the LED lighting apparatus according to the present invention;

FIG. 14 is a perspective view schematically illustrating another example of the LED lighting apparatus according to the present invention;

FIGS. 15 and 16 are views schematically illustrating the LED lighting unit module of the LED lighting apparatus according to the present invention; and FIG. 17 is a view illustrating a method of measuring illuminance uniformity of the LED lighting apparatus according to the present invention; and FIGS. 18 and 19 are graphs illustrating illuminance distribution of the LED lighting apparatus according to an embodiment of the present invention.

MODE FOR INVENTION

Hereinafter, the present invention will be described below in more detail with reference to the accompanying drawings.

A Light Emitting Diode (LED) lighting apparatus according to the present invention, which is installed at a location where a bottom surface requires uniform illuminance or luminance distribution, includes LED lighting unit modules having a plurality of LED light sources arranged on an inner or outer curved surface of a substantially half cylinder member, wherein two or more LED lighting unit modules are arranged in a longitudinal direction of the half cylinder member.

In an exemplary embodiment of the present invention, the LED lighting unit module serves as a fundamental component, and preferably, two or more LED lighting unit modules are arranged to construct the LED lighting apparatus.

The LED lighting unit module is configured in such a manner that the LED light sources are attached to the inner or outer curved surface of the substantially half cylinder member, and may be directly mounted to an LED light. Here, the term "substantially half cylinder" is a meaning including a wholly hollow half truncated cone, upper and lower ends of which have different diameters, as well as a strict half cylinder shape. Also, the inner or outer curved surface may be a smooth curved surface (FIG. 3), or may be defined by a plurality of polygonal segments, for example, a plurality of rectangular segments arranged to have predetermined angles with respect to each other in a width direction thereof. That is, the half cylinder member may have a width directional cross section in which curvilinear or segmented straight lines are consecutively connected to each other. In the latter case, the respective rectangular segments may serve as LED flat plate modules, which will be described further below. The LED flat plate modules may include an even number of symmetrically arranged LED flat plate modules (FIG. 4), or an odd number of horizontally arranged LED flat plate modules (FIG. 5). As described above, in the present invention, the LED lighting unit module may be configured to have a smooth curved surface, or may be configured such that a plurality of polygonal, more particularly, rectangular LED flat plate modules 121 and 131 is arranged in a width direction thereof. The neighboring LED flat plate modules are preferably arranged to have an angle of 150° or more and 175° or less with respect to each other in a width direction thereof.

For ease of explanation, FIGS. 3 to 5 illustrate a configuration in which the LED light sources are attached to the inner curved surface of the LED lighting unit module 110, 120, or 130. Of course, the present invention may be equally applied to the converse case in which the LED light sources are attached to the outer curved surface.

In the present invention, each of the LED light sources consists of an LED and a Printed Circuit Board (PCB) for driving the LED. The LED light source is attached to the inner or outer curved surface of the substantially half cylinder member. Although the plurality of LED light sources is described in a preferred embodiment of the present invention as being regularly arranged at a constant interval throughout the inner or outer curved surface, the present invention is not essentially limited thereto, and the number of the LED light sources may be appropriately selected as necessary. The LED light sources may be secured as fasteners are fitted into fastening holes perforated in the curved surface of the half cylinder member of the LED lighting unit module, or perforated in the LED flat plate modules, or may be attached to the curved surface by use of an adhesive.

As described above, two or more LED lighting unit modules may be provided. FIGS. 3 to 5 illustrate an embodiment in which a single LED lighting unit module is used, and FIGS. 6 to 8 and FIGS. 9 to 11 respectively illustrate embodiments in which a plurality of LED lighting unit modules is arranged to have a predetermined angle therebetween in a longitudinal direction of the LED lighting apparatus. In this case, the predetermined angle is indicated by "ψ" as illustrated in FIG. 13. Hereinafter, this angle will be referred to as a coupling angle.

The LED lighting unit module is provided at opposite ends thereof with protruding plates 111, 122, or 132 as illustrated in the drawings. The plates 111, 122, or 132 are used to attach the LED lighting unit module to a body of a street light. These plates are non-essential, and according to a coupling manner thereof, may be provided with fastening holes, or may be configured to be suitable for attachment without fastening holes.

FIG. 6 illustrates an example in which two LED lighting unit modules 110 illustrated in FIG. 3 are arranged in series, FIG. 7 illustrates an example in which two LED lighting unit modules 120 illustrated in FIG. 4 are arranged in series, and FIG. 8 illustrates an example in which two LED lighting unit modules 130 illustrated in FIG. 5 are arranged in series. A preferred range of the coupling angle between the respective neighboring LED lighting unit modules will be described below in detail with reference to the following concrete embodiments of the present invention.

The LED lighting apparatus according to the present invention, as illustrated in FIGS. 9 to 11, may be configured such that three LED lighting unit modules are consecutively arranged in series. FIG. 9 illustrates an example in which three LED lighting unit modules 110 illustrated in FIG. 3 are arranged in series, FIG. 10 illustrates an example in which three LED lighting unit modules 120 illustrated in FIG. 4 are arranged in series, and FIG. 11 illustrates an example in which three LED lighting unit modules 130 illustrated in FIG. 5 are arranged in series.

The above described arrangement of the LED light sources can provide uniform distribution of light emitted from the LEDs while minimizing the exposure of a driver to glare by focusing the light within a desired illuminating region, and also, can minimize rearward light leakage, resulting in highly effective lighting.

Hereinafter, the LED lighting apparatus according to the present invention, which includes the LED lighting unit module in which the LED light sources are attached to the inner or outer curved surface of the substantially half cylinder member, will be described in detail by way of example.

FIG. 12 is a view schematically illustrating an installation example of the LED lighting apparatus according to the present invention, and FIG. 13 is a perspective view schematically illustrating one example of the LED lighting apparatus according to the present invention, in which the LED light sources are attached to the outer curved surface of the half cylinder member.

Referring to FIGS. 12 and 13, the LED lighting apparatus according to the present invention is applicable to street lights 201 and 202, security lights, or the like, which are consecutively arranged in a longitudinal direction (i.e. a y-axis direction parallel to a lane) of a road surface "a" which requires uniform illuminance or luminance distribution. Each LED lighting unit module is composed of a plurality of LED flat plate modules on which LED light sources are arranged and secured.

Although the LED lighting apparatus may include a single LED lighting unit module, preferably, two or more, i.e. "m" LED lighting unit modules are consecutively arranged to construct a single light. In this case, the LED lighting unit modules may be arranged in a width direction of the road surface (i.e. an x-axis direction perpendicular to the arrangement direction of lighting apparatuses consecutively installed in a longitudinal direction of the road surface).

The LEDs, which constitute the light sources arranged on the LED flat plate modules, generally have a Lambertian characteristic at a given angle, and thus, have a view angle range $\Delta\eta$ (here, $\eta=\pm 60°$, and $\Delta\eta=120°$). Thus, it is possible to change the characteristics of the LED lighting apparatus by adding lenses to the LEDs, or by changing the structure of the LED light source. Here, the view angle range $\Delta\eta$ is an angular range in which the illuminance at the periphery is half that at the center.

In the present invention, the LED light source may include an LED, or an assembly of an LED and a lens. Specifically, a condensing lens may be integrated into the LED, or may be separately coupled to the LED, to constitute an assembly of the LED and the lens.

In this case, the view angle range $\Delta\eta$ of the LED light source is preferably in a range of ±5° (or 10°) to ±20° (or 40°).

In the LED lighting apparatus of the present invention, the LED lighting unit modules connected to each other have a predetermined coupling angle. For example, as illustrated in FIG. 13, if it is assumed that an LED lighting apparatus 300 is composed of two LED lighting unit modules 310 and 320, the two LED lighting unit modules 310 and 320 may be arranged in an x-axis direction to construct a single lighting apparatus in such a manner that the coupling angle ψ between the first LED lighting unit module 310 and the second LED lighting unit module 320 is preferably 40° or less, and more preferably, is determined so as to satisfy the following Equation 1.

$$(\Delta\eta-5°)\leqq\psi\leqq(\Delta\eta+5°) \quad \text{[Equation 1]}$$

FIG. 14 is a perspective view schematically illustrating another example of the LED lighting apparatus according to the present invention.

Referring to FIG. 14, an LED lighting apparatus 400 includes three LED lighting unit modules 410, 420 and 430. In this case, the first LED lighting unit module 410 and the second LED lighting unit module 420 are connected to each other so as to form a coupling angle $\psi_2$ therebetween, and the second LED lighting unit module 420 and the third LED lighting unit module 430 are connected to each other so as to form a coupling angle $\psi_3$ therebetween. In this way, if it is assumed that "m" LED lighting unit modules are coupled to each other, the respective neighboring LED lighting unit modules may form coupling angles of $\psi_2, \psi_3, \ldots \psi_m$. In this case, the coupling angles should satisfy the relationship $\psi_2<\psi_3<, \ldots <\psi_m$.

Preferably, the coupling angles satisfy the following Equation 2.

$$(\Delta\eta-5°)/(m-1)\leqq(\psi_{j+1}-\psi_j)\leqq(\Delta\eta+5°)/(m-1) \quad \text{[Equation 2]}$$

More preferably, the coupling angles satisfy the following Equation 3.

$$(\Delta\eta-5°)\leqq(\psi_{j+1}-\psi_j)\leqq(\Delta\eta+5°)\ (j=1, 2, 3, \ldots, m-1) \quad \text{[Equation 3]}$$

FIGS. 15 and 16 are views schematically illustrating the LED lighting unit module of the LED lighting apparatus according to the present invention. FIG. 15 is a front view (as illustrated in y-z plane), and FIG. 16 is a side view (as illustrated in x-z plane). In this case, the z-axis corresponds to the height direction of a street light.

A single LED lighting unit module 500 for use in the LED lighting apparatus according to the present invention is configured such that a plurality of LED light sources is arranged respectively on 2n or 2n+1 LED flat plate modules $M_i$ (here, "n" is a natural number equal to or greater than 3, and i=±1, ±2, . . . , ±n although 2n+1 LED flat plate modules includes i=0). The angle $\phi_{\pm i}$ between the y-axis and the LED flat plate module $M_i$ is determined to satisfy the relationship $\phi_{\pm i}\leqq\phi_{\pm i\pm 1}$ (double signs in the same order). The angle between the respective neighboring LED flat plate modules is represented by $180°-(\phi_{\pm i\pm 1}-\phi_{\pm i})$ or $180°-(\phi_{+1}+\phi_{-1})$ (double signs in the same order) (here, i=1, 2, . . . , n−1 although 2n+1 LED flat plate modules includes i=0) and is in a range of 150° or more and 175° or less. The LED light sources are installed on the inner or outer curved surface of the half cylinder member of the LED lighting unit module.

For example, the LED lighting unit module 500, as illustrated in FIG. 15, includes a plurality of LED flat plate modules 501, 501', 502, 502', 503, 503', 504, 504', 505, and 505'. Preferably, at least six LED flat plate modules are provided. Also, the LED flat plate modules may be arranged symmetrically on the basis of the z-axis of the LED lighting unit module 500.

In the LED lighting unit module, if it is assumed that the $i^{th}$ LED flat plate module $M_i$ has a luminous flux $\Phi_i$, the $i^{th}$ LED flat plate module satisfies the relationship $\Phi_{\pm i}\leqq\Phi_{\pm i\pm 1}$ (double signs in the same order) (here, i=1, 2, . . . , n−1 although 2n+1 LED flat plate modules includes i=0). Accordingly, the LED flat plate modules preferably satisfy the relationship $\Phi_{\pm n}/\Phi_{\pm 1}\geqq 2$ (double signs in the same order), and more preferably, the relationship $\Phi_{\pm n}/\Phi_{\pm 1}\geqq 5$ (double signs in the same order). Also, the 2n+1 LED flat plate modules preferably satisfy the relationship $\Phi_{\pm n}/\Phi_0\geqq 2$, and more preferably, the relationship $\Phi_{\pm n}/\Phi_0\geqq 5$.

To achieve uniform illuminance in a y-axis direction, as illustrated in FIG. 15, if it is assumed that the LED flat plate modules 501 (501'), 502 (502'), 503 (503'), 504 (504') and 505 (505') respectively have luminous fluxes $\Phi_1$, $\Phi_2$, $\Phi_3$, $\Phi_4$, and $\Phi_5$, the LED lighting unit module 500 is configured to satisfy the relationship $\Phi_1\leqq\Phi_2\leqq\Phi_3\leqq\Phi_4\leqq\Phi_5$, and preferably, the relationship $\Phi_5/\Phi_1\geqq 2$, and more preferably, the relationship $\Phi_5/\Phi_1\geqq 5$.

The plurality of LED flat plate modules 501, 501', 502, 502', 503, 503', 504, 504', 505 and 505' may be separate members so as to be assembled into the single lighting unit module 500, or may be replaced with a single member to satisfy the above described requirements and relationships.

Hereinafter, the LED lighting apparatus according to the embodiment of the present invention will be described.

As illustrated in FIG. 12, the LED lighting apparatus according to the present invention may be usable with a street light, which has an installation height H of 10 m and is spaced apart from a neighboring street light by a distance D of 35 m. In FIG. 12, the street lights 201 and 202 are respectively provided with overhangs 211 and 212 having a length OH of 1 m such that LED lighting apparatuses 221 and 222 are mounted to distal ends of the overhangs 211 and 212.

The LED lighting apparatuses 221 and 222 are designed to operate at 150 W. To this end, 52 LED packages each operating at 3 W are used, and the amount of current input into an LED package is controlled to allow each street light to operate at 150 W. In this case, the LED light source incorporates a lens to achieve a view angle range of $\Delta\eta=25°$.

As illustrated in FIG. 13, two LED lighting unit modules may be provided and connected to each other by the coupling angle $\psi$ of 25°, and each LED lighting unit module includes 26 assemblies of LEDs and lenses as illustrated in FIG. 15.

In this case, if it is assumed that the angle $\phi_i$ between the y-axis and the LED flat plate modules 501, 501' 502, 502', 503, 503', 504, 504', 505 and 505' are respectively $\phi_{\pm 1}=7°$, $\phi_{\pm 2}=21°$, $\phi_{\pm 3}=35°$, $\phi_{\pm 4}=49°$, and $\phi_{\pm 5}=63°$, and the luminous flux of the LED flat plate modules 501, 501' 502, 502', 503, 503', 504, 504', 505 and 505' are respectively $\Phi_1$, $\Phi_2$, $\Phi_3$, $\Phi_4$, and $\Phi_5$, the ratio thereof should be 1:1:2:2:7.

FIG. 17 is a view illustrating a method of measuring illuminance uniformity of the LED lighting apparatus according to the present invention, and FIGS. 18 and 19 are graphs illustrating illuminance distribution of the LED lighting apparatus according to an embodiment of the present invention. FIG. 18 illustrates illuminance distribution in an x-axis direction (perpendicular to a lane), and FIG. 19 illustrates illuminance distribution in a y-axis direction (parallel to a lane). It will be appreciated that the illuminance uniformity is greatly improved as compared to that of the prior art.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A Light Emitting Diode (LED) lighting apparatus installed at a location where a bottom surface requires uniform illuminance or luminance distribution, the LED lighting apparatus comprising LED lighting unit modules having a plurality of LED light sources arranged on a plurality of flat plate modules that form an inner or outer curved surface of a substantially half cylinder member, wherein two or more LED lighting unit modules are arranged in a longitudinal direction of the LED lighting apparatus, wherein the plurality of flat plate modules are angled relative to one another and a greater number of the LED light sources are installed at greater distances from a center of the half cylinder member so as to produce the uniform illuminance or luminance distribution.

2. The apparatus according to claim 1, wherein the half cylinder member has a width directional cross section in which curvilinear or segmented straight lines are consecutively connected to each other.

3. The apparatus according to claim 1, wherein:

the neighboring LED flat plate modules are arranged to form an angle of 150° or more and 175° or less therebetween in a width direction thereof.

4. The apparatus according to claim 1, wherein the neighboring LED lighting unit modules are arranged to have a coupling angle of 40° or less therebetween in a longitudinal direction thereof.

5. A Light Emitting Diode (LED) lighting apparatus installed at a location where a bottom surface requires uniform illuminance or luminance distribution, the LED lighting apparatus comprising LED lighting unit modules composed of a plurality of LED flat plate modules on which LED light sources are arranged, wherein an angle between 2n or 2n+1 LED flat plate modules of the LED lighting unit module (here, n is a natural number equal to or greater than 3) and an arrangement direction (y-axis) of the LED lighting apparatus is represented by $\phi_i$ (here, i=−n, −n+1, . . . , −1, +1, . . . , n although 2n+1 LED flat plate modules includes i=0), wherein an angle between the neighboring LED flat plate modules is represented by $180°-(\phi_{\pm i\pm 1}-\phi_{\pm i})$ or $180°-(\phi_{+1}+\phi_{-1})$ (double signs in the same order) (here, i=1, 2, . . . , n−1 although 2n+1 LED flat plate modules includes i=0) and is in a range of 150° or more and 175° or less, and wherein a greater number of the LED light sources are installed at greater distances from a center of an inner or outer curved surface of the LED lighting unit module so as to produce the uniform illuminance or luminance distribution.

6. The apparatus according to claim 5, wherein m LED lighting unit modules are consecutively arranged in a direction x-axis (perpendicular to the y-axis) (here, m is a natural number equal to or greater than 2).

7. The apparatus according to claim 6, wherein a coupling angle between the m LED lighting unit modules satisfies the relationship $\psi_j \leqq 40°$ (here, j=2, 3, . . . , m).

8. The apparatus according to claim 7, wherein the LED lighting unit modules includes two LED lighting unit modules coupled to each other so as to satisfy the relationship $(\Delta\eta-5°) \leqq \psi \leqq (\Delta\eta+5°)$ between a coupling angle and a view angle range.

9. The apparatus according to claim 7, wherein the LED lighting unit modules includes three or more LED lighting unit modules coupled to each other so as to satisfy the relationship $(\Delta\eta-5°) \leqq (\psi_{j+1}-\psi_j) \leqq (\Delta\eta+5°)$ (here, j=2, 3, . . . , m) between a coupling angle and a view angle range.

10. The apparatus according to claim 7, wherein the LED lighting unit modules includes three or more LED lighting unit modules coupled to each other so as to satisfy the relationship $(\Delta\eta-5°)/(m-1) \leqq (\psi_{j+1}-\psi_j) \leqq (\Delta\eta+5°)/(m-1)$ (here, j=2, 3, . . . , m) between a coupling angle and a view angle range.

11. The apparatus according claim 5, wherein a luminous flux of the $i^{th}$ LED flat plate module of the 2n or 2n+1 LED flat plate modules (here, n is a natural number equal to or greater than 3) satisfies the relationship $\Phi_{\pm i} \leqq \Phi_{\pm i\pm 1}$ (double signs in the same order) (here, i=1, 2, . . . , n−1 although 2n+1 LED flat plate modules includes i=0), and also, satisfies the relationship $\Phi_{\pm n}/\Phi_{\pm 1} \geqq 2$ (double signs in the same order) or the relationship $\Phi_{\pm n}/\Phi_0 \geqq 2$.

12. The apparatus according to claim 11, wherein each of the LED light sources includes an LED, or an assembly of an LED and a lens, and has a view angle range of ±5° or more and ±20° or less.

13. The apparatus according to claim 5, wherein a luminous flux of the $i^{th}$ LED flat plate module of the 2n or 2n+1 LED flat plate modules (here, n is a natural number equal to or greater than 3) satisfies the relationship $\Phi_{\pm i} \leqq \Phi_{\pm i\pm 1}$ (double signs in the same order) (here, i=1, 2, . . . , n−1 although 2n+1 LED flat plate modules includes i=0), and also, satisfies the relationship $\Phi_{\pm n}/\Phi_{\pm 1} \geqq 5$ (double signs in the same order) or the relationship $\Phi_{\pm n}/\Phi_{\pm 1} \geqq 5$.

* * * * *